United States Patent [19]

Kuchenbecker

[11] 4,119,203

[45] Oct. 10, 1978

[54] RECLOSABLE HINGED BLISTER CARD PACKAGE

[75] Inventor: Morris W. Kuchenbecker, Neenah, Wis.

[73] Assignee: American Can Company, Greenwich, Conn.

[21] Appl. No.: 831,507

[22] Filed: Sep. 8, 1977

[51] Int. Cl.[2] ..... B65D 83/00; B65D 85/14

[52] U.S. Cl. ..... 206/461; 206/467; 206/470; 206/621; 206/626

[58] Field of Search ..... 206/470, 461, 462, 467, 206/45.34, 626, 621; 229/45, 2.5

[56] References Cited

U.S. PATENT DOCUMENTS

| | | | |
|---|---|---|---|
| 2,923,455 | 2/1960 | Tingley | 229/45 |
| 3,127,010 | 3/1964 | Capezzuto | 206/626 |
| 3,685,649 | 8/1972 | Diehl | 206/462 |
| 3,800,998 | 4/1974 | Gask | 229/2.5 |

*Primary Examiner*—William T. Dixson, Jr.
*Attorney, Agent, or Firm*—Robert P. Auber; Ira S. Dorman; Harry C. Engstrom

[57] ABSTRACT

A reclosable hinged blister card package wherein the clear plastic blister is adhered to a paperboard card which is suitably cut-scored along the adhered areas to allow defined ply separation of the card for opening the blister. The blister is hinged at its bottom end to the card and has an opening tab overlaying a cut-out opening in the card. Locking ears on the opening tab are adapted to be pushed through the cut-out opening to lock the blister in reclosed position.

12 Claims, 8 Drawing Figures

RECLOSABLE HINGED BLISTER CARD PACKAGE

BACKGROUND OF THE INVENTION

This invention relates to blister card packages and more particularly to such a package with a reclosable hinged plastic blister.

SUMMARY OF THE INVENTION

A reclosable hinged blister card package having a clear plastic blister or product holding member with a peripheral attaching flange adhered to the front surface of a paperboard card. The side portions of the peripheral flange are adhered to the card between double cut-score lines or a single cut-score line and the edge of the card. The cut-score lines extend partially through the thickness of the card. The bottom portion of the flange is adhered outwardly of a single cut-score line so that the card provides a hinge at the bottom edge of the attaching flange outwardly of the adhered area. Such hinge may be either at the bottom folded edge of the card or at a score line impressed at the bottom edge of the plastic blister and above the bottom edge of the card. The card has a cut-out opening and the blister has an opening tab extending over a portion of the cut-out opening. The opening tab has locking ears which extend outwardly beyond the edge of the cut out opening and are adapted to be pushed through the opening when the blister is reclosed to overlay the back surface of the card to lock the package reclosed.

Further objects, features and advantages of the invention will be apparent from the following detailed description taken in conjunction with the accompanying drawings showing two embodiments for exemplification.

DETAILED DESCRIPTION OF THE PREFERRED EMBODIMENTS

Referring now more particularly to the drawings wherein like numerals refer to like parts throughout the several views, a first reclosable hinged blister card package is shown at 10 in FIGS. 1–4. The package comprises a paperboard card 11 having a front surface 11*a* and a back surface 11*b*. The card has an integral bottom panel 12 which is folded over and adhered to the back side of the card to provide a folded edge 13 at the bottom of the card. While only a short panel is shown, it could be co-extensive with the card to provide a double layer card which may be advantageous for thinner card stocks and to permit printing on both sides of the card with single pass printing before the panel is folded over and adhered to the backside of the card.

Figure 5:
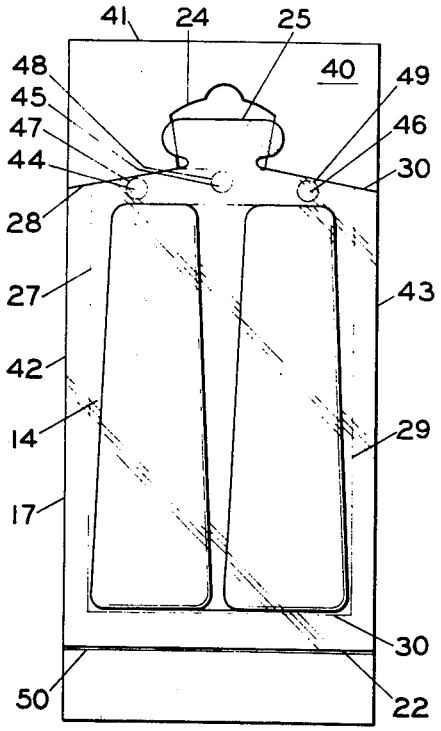
FIG. 5 is a plan view of a second embodiment of the package embodying the principles of this invention.
Figure 6:
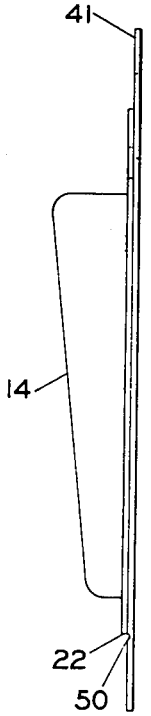
FIG. 6 is a right side view of the package of FIG. 5.
Figure 7:
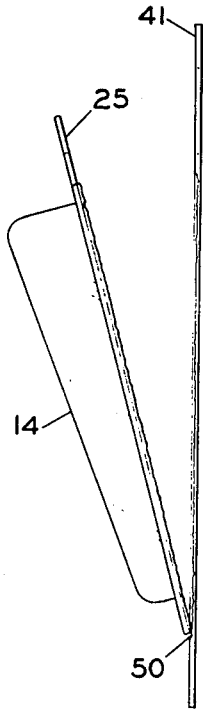
FIG. 7 is a right side view of the package of FIG. 5 opened.
Figure 8:
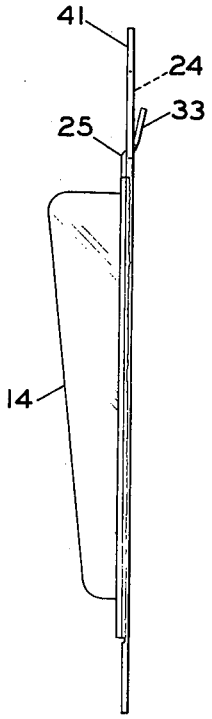
FIG. 8 is a right side view of the package of FIG. 5 reclosed.

A clear plastic blister 14 has a raised product holding portion 15 for holding one or more products such as tubes of tooth paste as illustrated at 16. The plastic blister has a peripheral attaching flange 17 having side portions 18 and 19, top portion 20, bottom portion 21 and a bottom edge 22. The side portions 18 and 19 and bottom portion 21 of flange 17 are adhered to the front surface of the card as shown. In the embodiment shown in FIG. 1, top portion 20 of the flange is not adhered to the card although, as shown in the second embodiment in FIG. 5, it may be if desired.

The card has an internal edge 23 defining a cut-out opening 24 in the card. A flexible opening tab 25 is provided on the plastic member and extends part way up the cut-out opening to allow finger space for gripping the tab for tearing open the package.

Cut-score lines 26, 27, 28, 29, 30 and 31 are provided in the front surface of the card and extend partially through the thickness of the card to allow confined ply separation of the paperboard when the opening tab is lifted to open the blister.

Figure 1:
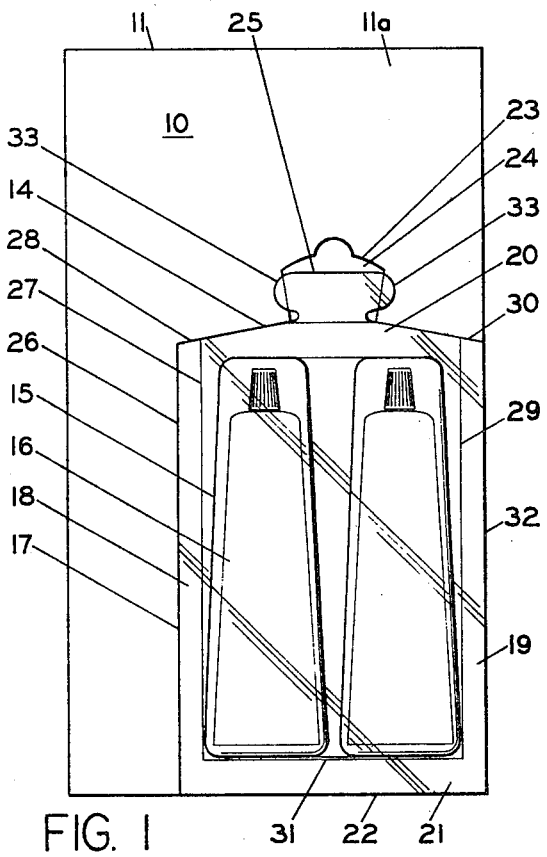
FIG. 1 is a plan view of a reclosable hinged blister card package embodying the principles of this invention.
Figure 3:
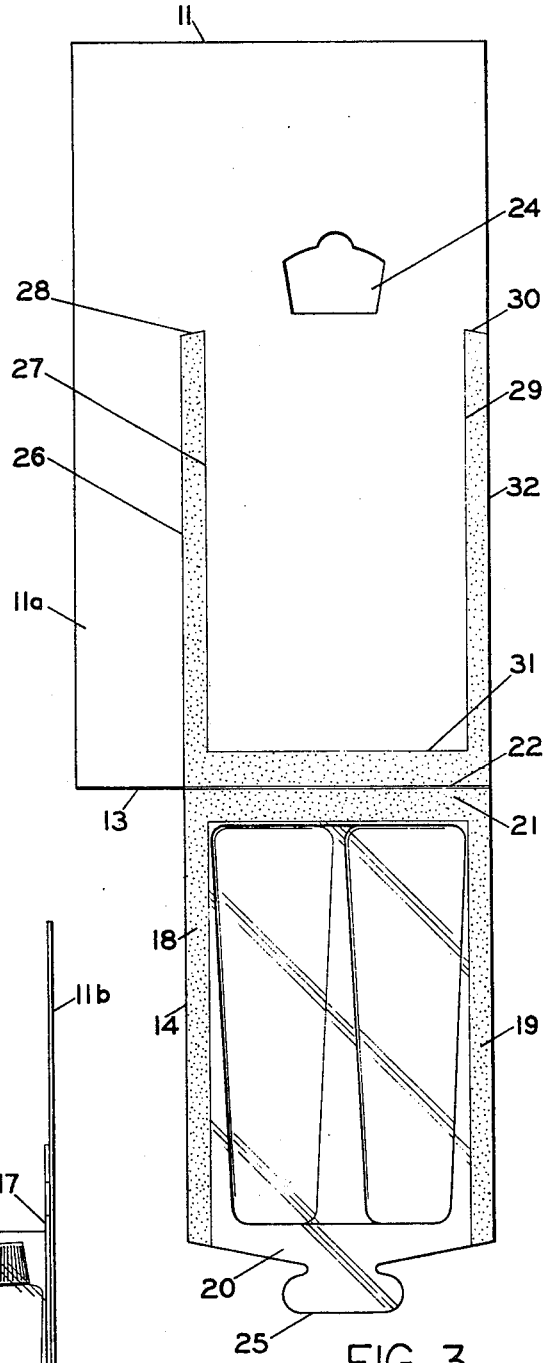
FIG. 3 is a plan view of the package of FIG. 1 opened.

Cut-score lines 26, 27 and 28 extend around the adhered side portion 18 of the flange. Cut-score lines 29 and 30, together with side edge 32 of the card, enclose the adhered area of side portion 19 of the flange. If the blister 14 were positioned such that the outer edge of side portion 19 was inside of the edge 32 of the card, such as if the blister were centered side-to-side on the card, then, another cut-score line would be provided in the card along the outer edge of flange side portion 19 similar to cut-score line 26 on the other side. Cut-score line 31 extends along the inside of the adhered bottom portion 21 of the attaching flange, and the bottom edge 22 of the bottom flange portion 21 extends along the folded bottom edge 13 of the card to provide a hinge connection to the card at the bottom thereof. This design provides for confined tearing or ply separation of the paperboard card without breaking the adhesive bond when the blister 14 is swung open as shown in FIG. 3.

Figure 4:
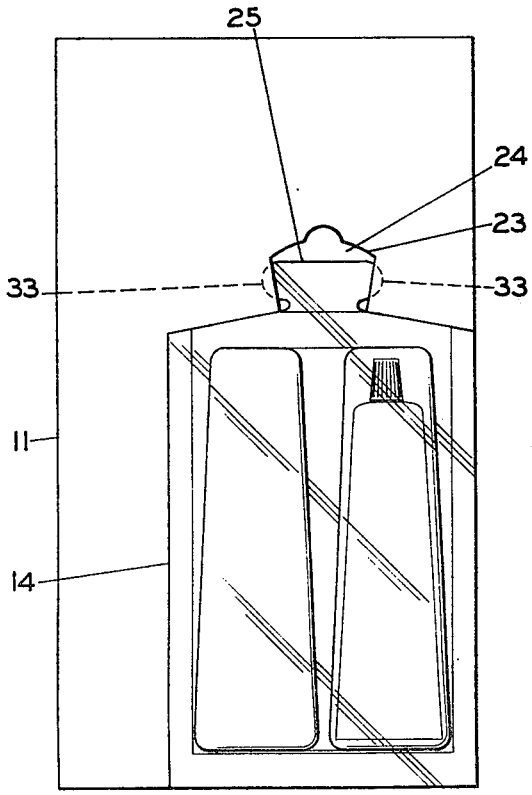
FIG. 4 is a plan view of the package of FIG. 1 reclosed.
Figure 2:
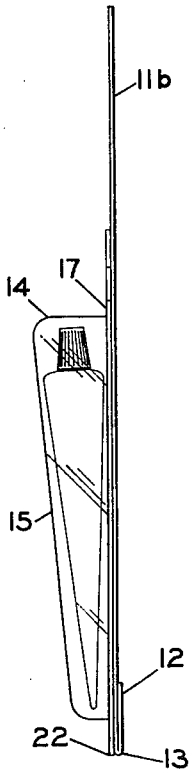
FIG. 2 is a right side view of the package of FIG. 1.

The package may be reclosed as shown in FIG. 4 and secured in the reclosed condition by locking ears 33 on the opening tab which extend outwardly beyond the edge 23 of the cut-out opening 24 so that the ears are adapted to be pushed through said cut-out opening to overlay the back surface of the card when the package is reclosed.

The second embodiment 40, shown for exemplification in FIGS. 5–8, has a paperboard card 41 wherein the plastic blister 14 which is identical to the blister in the first embodiment is the same width as the card but, the card extends below the bottom edge 22 of the blister. In this form there is no need for cut-score lines along the outer edges of the adhered side portions of the attaching flange 17 of the blister 14 because those outer edges are at the side edges 42 and 43 of the card 41. The other cut-score lines 27, 28, 29, 30 and 31 are provided as in the first embodiment shown in FIGS. 1–4. In the second embodiment 40, three adhesive spots 44, 45 and 46 are shown for exemplification for adhering the top portion 20 of the attaching flange to the front surface of the card 41. In this case, those adhesive spots are enclosed within three circular cut-score lines 47, 48 and 49 which extend part way into the paperboard to permit confined ply separation of the paperboard at those adhered spots without breaking the adhesive bond.

The card 41 has a hinge score line 50 impressed therein along the bottom edge 22 of the attaching flange of the blister 14 to resist tearing of the paperboard below the hinge line when the package is opened.

It is understood that this invention is not confined to the particular construction and arrangement of parts herein illustrated and described, but embraces all such modified forms as come within the scope of the following claims.

I claim:

1. A reclosable hinged blister card package comprising:

(a) a paperboard card having a front surface and a back surface and an internal edge defining an opening in said card;

(b) a plastic blister having a bottom edge, a raised product holding portion, and a peripheral flange at the sides and bottom of said blister, said peripheral flange being adhered to the front surface of said card;

(c) opening tab means on said plastic blister and extending over at least a portion of said opening in said card and adapted to be pushed through said opening when said blister is reclosed for locking said blister in its reclosed position; and (d) cut-score lines in the front surface of said card and extending partially through the thickness of said card along the inner and outer edges of said peripheral flange except along the bottom edge of said plastic blister whereby said blister may be lifted by said opening tab means with confined ply separation of the paperboard card at the portions thereof which are adhered to said peripheral flange without breaking the bond between said flange and the front surface of the paperboard card and permitting said plastic blister to be swung open about its bottom edge hinged connection to said card.

2. The reclosable hinged blister card package as specified in claim 1 wherein said paperboard card has a bottom panel integral with said card and which is folded over and adhered to the back surface of said card, the bottom edge of said plastic blister being at the bottom of said card to provide a hinge at the bottom fold of said card.

3. The reclosable hinged blister card package of claim 1 wherein said opening tab means includes locking ears extending outwardly beyond the edge of said opening in said card, said ears being adapted to be pushed through said opening when said blister is reclosed to overlay the back surface of said card to lock said blister in a reclosed position.

4. The reclosable hinged blister card package of claim 1 wherein an impressed hinge line is formed in said card at the bottom edge of said peripheral flange on said blister to thereby facilitate the hinged opening of said blister about said impressed hinge line.

5. A reclosable hinged blister card package comprising:

(a) a paperboard card having a front surface and a back surface and an internal edge defining an opening in said card;

(b) a plastic blister having a bottom edge, a raised product holding portion, and a peripheral flange at the sides and bottom of said blister, said peripheral flange being adhered to the front surface of said card with one side edge of said flange at one of the side edges of said card;

(c) opening tab means on said plastic blister and extending over at least a portion of said opening in said card and adapted to be pushed through said opening when said blister is reclosed for locking said blister in its reclosed position; and (d) cut-score lines in the front surface of said card and extending partially through the thickness of said card along the inner and outer edges of said peripheral flange except along the bottom edge of said plastic blister and along the one side edge of the flange which is at one of the side edges of said card, whereby said blister may be lifted by said opening tab means with confined ply separation of said paperboard card at the portions thereof which are adhered to said peripheral flange without breaking the bond between said flange and the front surface of said paperboard card and permitting said plastic blister to be swung open about its bottom edge hinged connection to said card.

6. The reclosable hinged blister card package of claim 5 wherein said paperboard card has a bottom panel integral with said card and which is folded over and adhered to the back surface of said card, the bottom edge of said plastic blister being at the bottom of said card to provide a hinge at the bottom fold of said card.

7. The reclosable hinged blister card package of claim 5 wherein said opening tab means includes locking ears extending outwardly beyond the edge of said opening in said card, said ears being adapted to be pushed through said opening when said blister is reclosed to overlay the back surface of said card to lock said blister in a reclosed position.

8. The reclosable hinged blister card package of claim 5 wherein an impressed hinge line is formed in said card at the bottom edge of said peripheral flange on said blister to thereby facilitate the hinged opening of said blister about said impressed hinge line.

9. A reclosable hinged blister card package comprising:

(a) a paperboard card having a front surface and a back surface and an internal edge defining an opening in said card;

(b) a plastic blister having a bottom edge, a raised product holding portion, and a peripheral flange at the sides and bottom of said blister, said peripheral flange being adhered to the front surface of said card with the outer side edges of said flange at the side edges of said card;

(c) opening tab means on said plastic blister and extending over at least a portion of said opening in said card and adapted to be pushed through said opening when said blister is reclosed for locking said blister in its reclosed position; and (d) cut-score lines in the front surface of said card and extending partially through the thickness of said card along the inner and outer edges of said peripheral flange except along the bottom edge of said plastic blister and along the outer side edges of said flange, whereby said blister may be lifted by said opening tab means with confined ply separation of said paperboard card at the portions thereof which are adhered to said peripheral flange without breaking the bond between said flange and the front surface of said paperboard card and permitting said plastic blister to be swung open about its bottom edge hinged connection to said card.

10. The reclosable hinged blister card package of claim 9 wherein said paperboard card has a bottom panel integral with said card and which is folded over and adhered to the back surface of said card, the bottom edge of said plastic blister being at the bottom of said card to provide a hinge at the bottom fold of said card.

11. The reclosable hinged blister card package of claim 9 wherein said opening tab means includes locking ears extending outwardly beyond the edge of said opening in said card, said ears being adapted to be pushed through said opening when said blister is reclosed to overlay the back surface of said card to lock said blister in a reclosed position.

12. The reclosable hinged blister card package of claim 9 wherein an impressed hinge line is formed in said card at the bottom edge of said peripheral flange on said blister to thereby facilitate the hinged opening of said blister about said impressed hinge line.

* * * * *